United States Patent [19]

Bako

[11] 4,354,366

[45] Oct. 19, 1982

[54] COMBINATION LOCKS

[75] Inventor: Lazlo Bako, Woodcliff Lake, N.J.

[73] Assignee: Kidde, Inc. (Presto Lock Company Division), Garfield, N.J.

[21] Appl. No.: 167,490

[22] Filed: Jul. 11, 1980

[51] Int. Cl.[3] ..... E05B 37/02

[52] U.S. Cl. ..... 70/312; 70/318

[58] Field of Search ..... 70/20–30, 70/67–76, 312, 315–318

[56] References Cited

U.S. PATENT DOCUMENTS

| | | | |
|---|---|---|---|
| 3,720,082 | 3/1973 | Feinberg et al. | 70/25 |
| 3,766,758 | 10/1973 | Heine et al. | 70/25 |
| 3,800,571 | 4/1974 | Heine | 70/71 |
| 3,983,724 | 10/1976 | Foote | 70/316 |
| 4,048,821 | 9/1977 | Bako et al. | 70/25 |
| 4,123,923 | 11/1978 | Bako | 70/74 |

*Primary Examiner*—Robert L. Wolfe

*Attorney, Agent, or Firm*—Shapiro and Shapiro

[57] ABSTRACT

A dial and sleeve type combination lock is provided with a shift mechanism for moving the sleeves out of coupling engagement with the dials for changing the combination of the lock. The shift mechanism includes a rotary actuator mounted coaxially with the sleeves and having a portion of its periphery extending through an opening in the face plate of the lock. When the lock is on combination, the actuator can be rotated to move the sleeves out of coupling engagement with the respective dials by a camming action.

11 Claims, 9 Drawing Figures

COMBINATION LOCKS

BACKGROUND OF THE INVENTION

The use of combination locks, which dispense with the need for a separate key, has in recent years become increasingly popular on articles such as luggage articles, camera, and instrument cases, and the like.

Such locks commonly employ a mechanism whereby the combination of the lock can be changed to one of the user's own choice, by manipulation of a combination changing device. In the case of locks, for example of the rotary dial and sleeve type, where for combination changing it is necessary to move the sleeves or other combination elements axially out of coupling engagement with the dials or the like, this is normally accomplished by a shift member having a manual actuator. Generally, the actuator has only been accessible from the back of the lock, i.e., from the interior of the article to which the lock is applied and, in certain instances, this has proved to be cumbersome in operation. Further, the actuator has generally needed to be moved in the axial direction of movement of the sleeves relative to the dials in order to uncouple the dials from the sleeves. (See, for example, U.S. Pat. No. 3,800,571 to Heine, issued Apr. 2, 1974, and commonly assigned herewith.)

It is an object of the present invention to provide a novel form of shift mechanism for a combination lock of the type in which a plurality of combination elements, such as sleeves, are moved axially in unison in order to effect a combination change.

Another object of the invention is to provide in a combination lock of the type having a plurality of combination elements adapted to be moved axially in unison in order to effect a combination change, a shift mechanism including a rotary actuator.

A further object of the invention is to provide a combination lock suitable for use on articles of luggage and the like, wherein a shift mechanism for changing the combination of the lock is readily accessible from the exterior of an article to which the lock is applied.

It has previously been proposed in connection with combination padlocks, for example, which employ rotary dials and sleeves, to move the sleeves out of coupling engagement with the dials by utilizing the longer leg of the padlock shackle to provide axial movement of the sleeves by movement of the shackle in a direction other than the direction of axial movement of the sleeves, see, for example, U.S. Pat. No. 3,766,758 to Heine et al. issued Oct. 23, 1973 and U.S. Pat. No. 4,048,821 to Bako et al., issued Sept. 20, 1977. The present invention, however, is primarily concerned with providing alternative and simplified means for effecting axial movement of the combination elements, for combination changing purposes, by means of an actuator which is operated other than in the direction of movement of elements, and specifically an actuator which is moved in a rotational manner to effect such movement.

SUMMARY OF THE INVENTION

In accordance with the invention, at least in a preferred embodiment thereof, a shift mechanism incorporating a rotary actuator is disposed on a common shaft along with a series of combination elements which are to be moved axially in unison out of coupling engagement with respective cooperating combination components in order to effect a combination change. The rotary actuator includes a cam arrangement whereby rotation of the actuator in one direction effects the required axial movement of the combination elements.

Preferably, the combination elements comprise a series of combination sleeves disposed end-to-end on the shaft, each sleeve cooperating with an encircling combination dial. The dials have peripheral portions extending through slots in a face plate of the lock, and the rotary actuator has a peripheral portion which projects through a further slot in the lock face plate. Accordingly, the actuator can be operated from the top of the lock, i.e., from the exterior of an article to which the lock is applied.

In one preferred form of the invention, the shift mechanism cooperates with a locking member of the lock, for example, a pivotal bolt, in a manner whereby the shift mechanism can only be operated when the locking member is in an unlocked position. Further, the shift mechanism may cooperate with the locking member so as to hold the locking member in an unlocked position during a change in the combination of the lock, thereby avoiding a loss of combination.

DESCRIPTION OF PREFERRED EMBODIMENT

The illustrated combination lock is of a generally known type employing a locking member in the form of a pivotal bolt adapted to engage a hasp, the bolt being movable between locking and unlocked positions under the control of a plurality of combination dials and sleeves. The arrangement is such that when the dials and sleeves are on combination, the bolt automatically assumes an unlocked position, in which the hasp can be inserted into or withdrawn from the lock, and when the dials and sleeves are off combination, the bolt automatically assumes its locking position in which it prevents an inserted hasp from being withdrawn from the lock.

Locks having the above type of locking and unlocking action are known, see, for example, U.S. Pat. No. 3,800,571 referred to above. It is to be understood that the present invention is not concerned with the locking and unlocking action per se, and this form of lock is merely used for illustrative purposes as one type of lock to which the present invention may be applied. Thus, the present invention is concerned with a shift mechanism for moving combination elements, such as sleeves, axially out of coupling engagement with associated lock components in order to effect a combination change. The invention can be applied to locks having a locking and unlocking action different to the pivotal bolt type of locking and unlocking action herein referred to.

Figure 1:
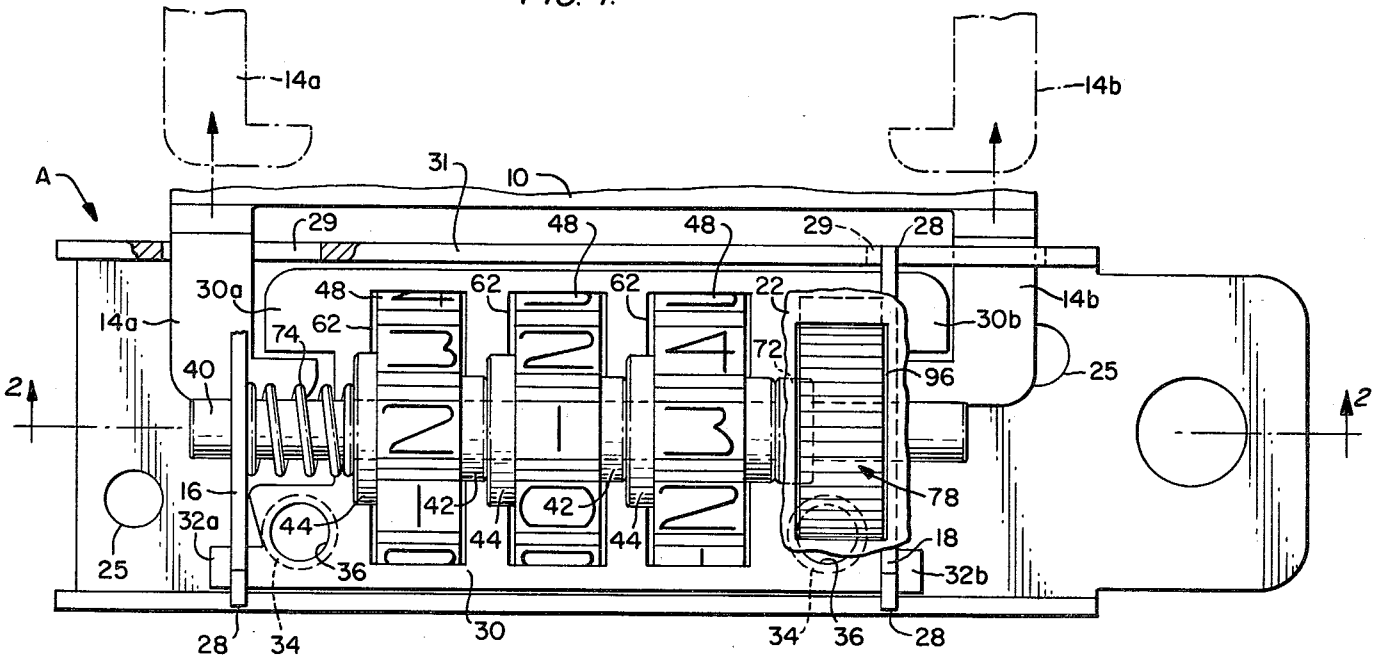
FIG. 1 is a plan view of a combination lock in accordance with the invention, with parts of the lock being cut away.

Referring now specifically to the drawings, the illustrated lock generally indicated by reference A, may be attached to a valance B of one section of say a luggage article (see FIG. 3) with the other section C of the article carrying a hasp 10 having projecting tongues 14*a*, 14*b* (FIG. 1) adapted to enter openings in the lock and engage a pivotal bolt 30 to releasably secure the sections of the luggage or like article together.

Lock A has a casing which may, for example, be formed by a channel-shaped base member 20, a face plate 22, side wall members 24 and 26 and end brackets 16 and 18. The design and assembly of the casing components is not critical and can follow established practice for locks of this type. As illustrated, base member 20 has openings 25 for attaching the lock, as by screws, rivets, or the like, to valance B and side wall member 24 has openings 27 aligned with similar openings 29 in upright wall 31 of the base member, for admission of the hasp tongues 14*a* and 14*b*.

Figure 6:
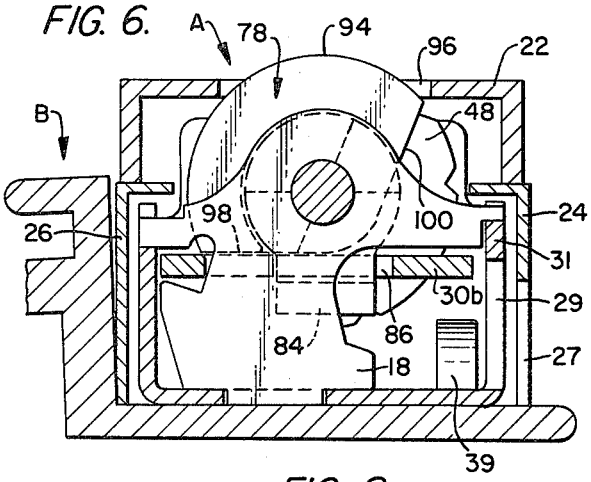
FIG. 6 is a view similar to FIG. 4 but showing the lock components in a combination changing position.
Figure 9:
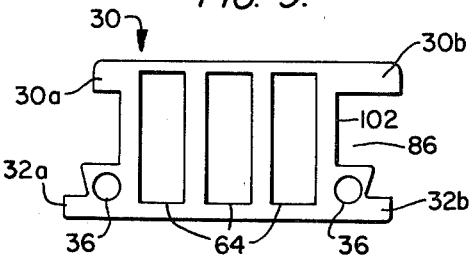
FIG. 9 is a plan view of a pivotal bolt.

Brackets 16 and 18 which define opposite end walls of the casing, respectively, may, for example, be located in recesses 28 in the opposed upright walls of the base member 20. The pivotal bolt 30 (FIG. 9) is mounted in brackets 16 and 18 by ears 32*a*, 32*b* of the bolt which fit in corresponding openings in the brackets, and coil compression springs 34 act between base member 20 and bosses 36 on the undersurface of the bolt, to urge the bolt upwardly into the position shown in FIGS. 2 and 6, and shown in solid line in FIGS. 3 and 4. In this, the unlocked position of the bolt, the hasp tongues 14*a* and 14*b* are free to enter and to be removed from the lock through oopenings 27 and 29. When bolt 30 is lowered, however, to the locking position, against springs 34, by means to be described, and as shown in phantom in FIGS. 3 and 4, bolt tongues 30*a* and 30*b* align vertically with the hasp tongues 14*a* and 14*b* to prevent disengagement with the hasp. Downward movement of bolt 30 is limited by a stop 39 on base member 20.

Brackets 16 and 18 also serve to mount a shaft 40 carrying a series of combination elements in the form of sleeves 42 disposed end-to-end on the shaft, and encircling combination dials 48. The dials and sleeves are of conventional type insofar as the dials have internal teeth 56 or the like which mesh with complementary teeth 58 or the like on the sleeves, whereby the dials and sleeves are coupled for mutual rotation on shaft 40. The dials also have a conventional series of circumferential combination indicia on their outer surfaces, with locating detents 60 therebetween and a portion of the periphery of each dial protrudes from casing 10 through respective slots 62 in face plate 22. Similarly, the dials protrude through aligned slots 64 in bolt 30. A conventional dial spring 68 on base member 20 has limbs 70 engaging the detents 60 of the respective dials.

Figure 2:
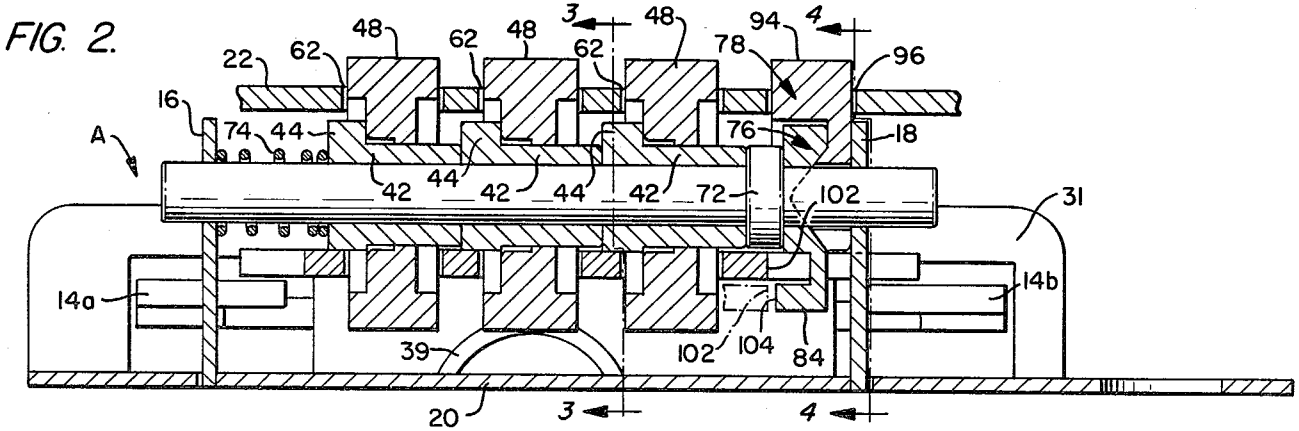
FIG. 2 is a longitudinal section along line 2—2 of FIG.

Shaft 40 further has a fixed or integrally formed collar 72 adjacent the right end sleeve 42 and a coil spring 74 surrounding the shaft and acting between bracket 16 and left end sleeve. Between collar 72 and bracket 18, and shaft 40 carries a shift mechanism in the form of a cam member 76 and an abutting rotary actuator 78. Spring 74 urges the assembly of sleeves, shaft and shift mechanism to the right as seen in FIG. 2, and holds the sleeves in coupling engagement with the respective dials.

Figure 3:
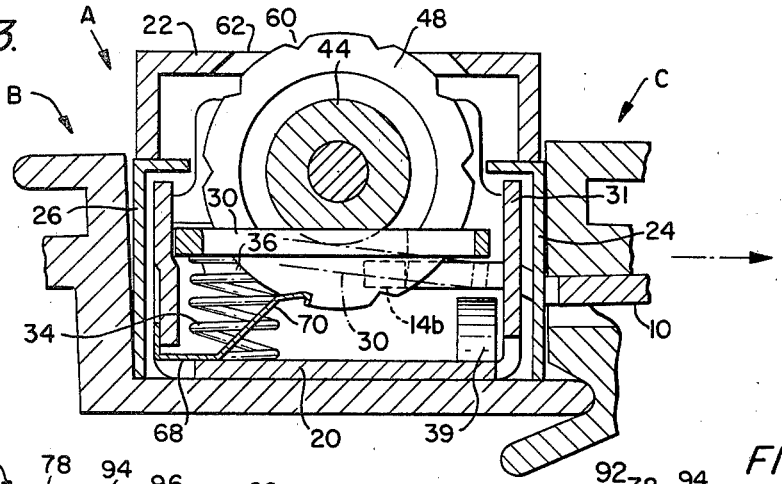
FIG. 3 is a cross section along line 3—3 of FIG. 2.

Sleeves 42 have enlarged bosses 44 at the left-hand ends thereof defining circumferential cam surfaces. These cam surfaces have part-circular portions 46 and flattened portions 50, and the cam surfaces act on the upper surface of bolt 30 to control the position of the bolt. Thus, when all the sleeves are aligned by suitable manipulation of the dials, such that the flattened portions of the respective sleeves all engage the bolt (i.e., the on-combination condition) as shown in FIGS. 2 and 3, the bolt is free to rise to the unlocked position. If at least one of the sleeves is rotated from this position, the part-circular portion of the sleeve's cam surface cams the bolt down to the locked position. Thus, for the bolt to be unlocked, all the sleeves must have their flat portions in aligned engagement with the bolt and for the bolt to be locked, any one or more of the sleeves must be rotated so that the part-circular cam portion engages the bolt. This form of locking and unlocking action, as indicated, is known and will be readily apparent to those skilled in the art.

To enable the combination of the lock to be changed, it is necessary to move sleeves 42 axially out of coupling engagement with the respective dials, so that at least one of the dials can be rotated independently of its respective sleeve. This is accomplished by shift mechanism 76, 78 when the lock is on combination, as will now be described.

Figure 7:
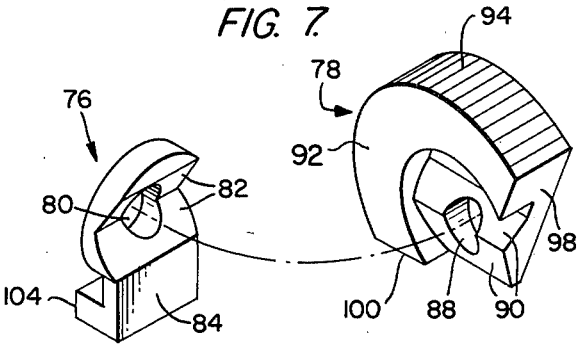
FIG. 7 is an exploded perspective view of a rotary actuator and cam member together forming the shift mechanism for the lock.
Figure 8:
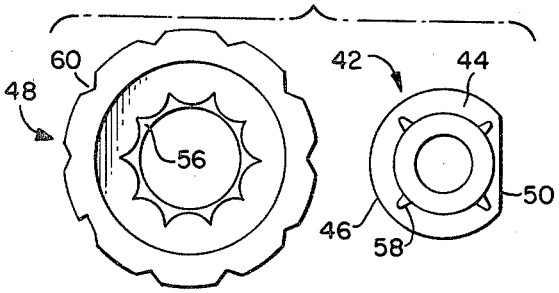
FIG. 8 is a composite end view of a combination dial and a combination sleeve.

Cam member 76 is mounted on shaft 40 through a central opening 80 of the cam member and as illustrated, particularly in FIG. 7, the cam member includes oppositely inclined cam surfaces 82. The cam member further includes a depending substantially L-shaped extension 84 which fits in a cut-out 86 in bolt 30. The actuator 78 fits on the shaft through a central opening 88 and has oppositely inclined camming surfaces 90 complementary to the surfaces 82 on cam member 76. Actuator 78 further includes an enlarged flange portion 92 which may conveniently have a knurled or similarly roughened outer periphery 94. A portion of the periphery of the manual actuator 78 protrudes through the face plate 22 of the lock through an opening 96. Further, the manual actuator has terminal surfaces 98 and 100 which engage the upper surface of bolt 30 in the opposed extreme rotational positions of the actuator member known respectively in FIGS. 4 and 6. The shift mechanism is assembled on shaft 40 with the flange portion of the manual actuator 78 encircling cam member 76 and with the cam surfaces of the respective members in aligned engagement. Spring 74, through shaft collar 72 presses the right-hand surface of the manual actuator into engagement with the internal surface of bracket 18.

Figure 4:
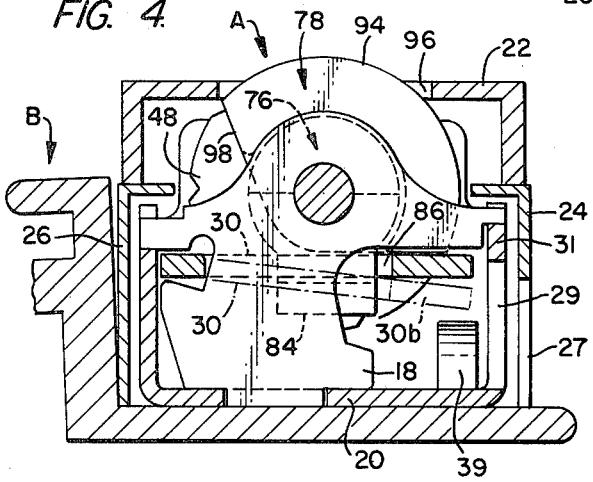
FIG. 4 is a cross section along line 4—4 of FIG. 2.
Figure 5:
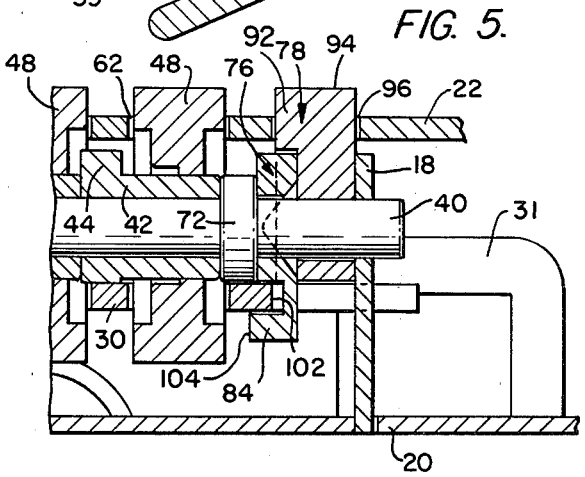
FIG. 5 is a view similar to FIG. 2 but showing parts of the lock in a combination changing position.

In the normal rest position of the shift mechanism, the manual actuator is in the position illustrated in FIGS. 2 and 4. When the lock is off combination, the bolt being in its locked, lowered position shown in phantom in FIGS. 2, 3 and 4, bolt surface 102 is in blocking position with respect to end surface 104 of the cam member 76 (see FIG. 1), precluding axial movement of the cam member. Further, because of the situation of extension 84 in cut-out 86 of bolt 30, cam member 76 cannot effectively rotate with respect to shaft 40. Accordingly, the cam member and manual actuator are effectively locked together through the interfitting cam surfaces 82 and 90, and manual actuator 78 cannot be rotated in the counterclockwise direction from the position shown in FIG. 4. When the lock is on combination, however, with the bolt in its raised, unlocked position, surface 102 of bolt 30 clears surface 104 of projection 84 on cam member 76 and thereby frees the cam member for axial movement. Thus, when a counterclockwise (as seen in FIG. 4) rotational force is applied to actuator 78, via the protruding peripheral portion thereof, misalignment of cam surfaces 82 and 88 can occur, due to the freedom of cam member 76 to move axially while the rear surface of actuator 78 reacts with the interior surface of bracket 18. Accordingly, when the manual actuator is rotated in this manner, to the terminal position shown in FIG. 6, a camming action is produced between the actuator and cam member 76 shifting cam member 76 to the left as seen in FIG. 2 and, through collar 72, also shifting shaft 40 and sleeves 42 to the left to uncouple the sleeves from the respective dials, and allowing the dials to be rotated independently of the sleeves to change the combination. In the combination-changing condition of the lock shown in FIGS. 5 and 6, the horizontal limb of extension 84 engages under bolt 30 (see FIG. 5), and prevents the bolt from being moved down into the locked position thereby preventing sleeves 42 from rotating and losing the combination.

It will be seen from the above that uncoupling of the sleeves from the respective dials is produced by a camming action between actuator 78 and cam member 76 through rotation of the actuator, with the right-hand surface of actuator 78 reacting with the internal surface of bracket 18. To re-engage the sleeves with the respective dials, manual actuator 78 is rotated in the clockwise direction from the FIG. 6 position to the FIG. 4 position and spring 74 returns the sleeves into coupling engagement with the respective dials and also, through collar 72 returns cam member 76 to the rest position shown in FIG. 2.

It will be seen from the foregoing that the invention provides a convenient form of shift mechanism for use with combination locks, suitable for application to articles of luggage and the like, which shift mechanism can be operated from the top of the lock casing, i.e., from externally of the article to which the lock is applied.

While only a single preferred embodiment of the invention has been described herein in detail, it is to be understood that the invention is not limited thereby and modifications can be made within the scope of the attached claims.

I claim:

1. A combination lock including a plurality of combination elements disposed on a common axis in a casing for axial movement in unison out of coupling engagement with cooperating combination components in order to change the combination of the lock, a shift mechanism for moving said elements axially, said shift mechanism including an actuator mounted for rotation about said axis, means providing a camming action between said actuator and said elements for causing said shift mechanism to move said elements axially responsive to rotary motion of said actuator in one direction, and means for restricting the rotary motion of the actuator to forward and reverse motion between opposed extreme positions, the combination elements in one extreme position of the actuator being in coupling engagement with the cooperating components and in the other extreme position of the actuator being out of coupling engagement with the cooperating components.

2. A lock as defined in claim 1, wherein said means for restricting the rotary motion of the actuator includes opposed terminal surfaces of the actuator which respectively engage means within the lock casing in the respective extreme positions of the actuator.

3. A lock as defined in claim 2, wherein said means within the casing comprises a movable locking member controlled by the combination elements for movement between locking and unlocking positions.

4. A lock as defined in claim 1, wherein said combination elements are disposed end-to-end on a shaft in said casing and said actuator comprises a manual actuator mounted for rotation on said shaft adjacent a terminal one of said elements, said actuator having a peripheral portion extending through an opening in said casing for effecting manual rotation thereof.

5. A lock as defined in claim 4, wherein said shift mechanism includes a cam member non-rotatably mounted on said shaft between said actuator and said terminal one of said elements, said actuator and said cam member having complementary camming surfaces for producing said camming action effective to move said elements axially responsive to rotational movement of the actuator in said one direction by reaction of said actuator with an internal surface of said casing.

6. A lock as defined in claim 5, wherein the peripheral portion of the actuator comprises a flange portion encircling the cam member.

7. A lock as defined in claim 4, wherein said combination elements comprise combination sleeves and said cooperating combination components comprise dials encircling said sleeves, said dials having peripheral portions extending through slots in a face plate of the lock, and said opening being formed in said face plate.

8. A lock as defined in claim 5, including a collar on said shaft between said terminal one of said sleeves and said cam member, said cam member engaging said collar to move said shaft and said sleeves axially responsive to rotational movement of said manual actuator in said one direction.

9. A lock as defined in claim 4, including a locking member in said casing controlled by said combination elements for movement between locking and unlocked positions, said cam member including an extension adapted to engage said locking member when said locking member is in locking position for inhibiting rotational movement of said manual actuator, said extension clearing said locking member when said locking member is in unlocked position.

10. A lock as defined in claim 8, wherein said extension has a portion adapted to engage said locking member when said combination elements are uncoupled from said cooperating combination components for retaining said locking member in unlocked position.

11. A lock as defined in claim 8, wherein said locking member is a pivotal bolt and said sleeves each include a flange having a cam surface engaging said bolt for controlling movement of said bolt between said locking and unlocked positions dependent upon the alignment of the respective cam surfaces.

* * * * *